US006135167A

United States Patent [19]

Kiholm

[11] Patent Number: 6,135,167

[45] Date of Patent: Oct. 24, 2000

[54] METHOD AND APPARATUS FOR A FILLER VALVE

[75] Inventor: Robert Kiholm, Selah, Wash.

[73] Assignee: Kiholm Industries LLC., Yakima, Wash.

[21] Appl. No.: 09/115,421

[22] Filed: Jul. 14, 1998

[51] Int. Cl.[7] ..... B65B 1/04

[52] U.S. Cl. ..... 141/59; 141/291; 141/157

[58] Field of Search ..... 141/59, 291–295, 141/156–162, 172

[56] References Cited

U.S. PATENT DOCUMENTS

| | | | |
|---|---|---|---|
| 724,341 | 3/1903 | Sheffield | 141/291 |
| 912,236 | 2/1909 | Falls | 141/291 |
| 2,671,591 | 3/1954 | Franz | 226/116 |
| 2,896,674 | 7/1959 | Day et al. | 141/305 |
| 2,989,091 | 6/1961 | Lowenthal | 141/18 |
| 3,073,358 | 1/1963 | Burt | 141/59 |
| 4,102,365 | 7/1978 | Jordan et al. | 141/39 |
| 4,349,055 | 9/1982 | DiChiara | 141/39 |
| 4,363,339 | 12/1982 | Puskarz | 141/39 |
| 4,442,873 | 4/1984 | Yun | 141/39 |
| 4,653,249 | 3/1987 | Simonazzi | 53/273 |
| 5,025,991 | 6/1991 | Stainbrook et al. | 239/459 |
| 5,058,632 | 10/1991 | Lawarre, Sr. et al. | 141/39 |
| 5,139,058 | 8/1992 | Yun | 141/40 |
| 5,150,740 | 9/1992 | Yun | 141/6 |
| 5,413,153 | 5/1995 | Zwilling et al. | 141/39 |

OTHER PUBLICATIONS

1147 Nozzle Assembly, Laub\Hunt, 13547 Excelsior Drive, Norwalk, CA 90650 (Aug. 20, 1997).

Nozzle, Packaging Dynamics Ltd., 640 A Broadway Avenue, Holbrook, NY 11741 (Apr. 28, 1998).

BM 8316 SS Filler Gravity Filling Tube Assem., U.S. Bottlers Mach'y Co. (Jun. 16,1983).

*Primary Examiner*—Steven O. Douglas
*Attorney, Agent, or Firm*—Stratton Ballew PLLC

[57] ABSTRACT

An improved filling valve specially configured for attachment onto a conventional, high speed liquid filling machine that is typically utilized in food product container packaging lines to quickly fill large numbers of containers, such as bottle or cans. A filler valve has several improvements that result in greater reliability in operation, increased operational speed, and easier adjustment in operational parameters. The filler valve including a manifold that receives a manifold insert and a spring nut that abuts to a slider. The slider is the only moving part of the filler valve. A filler stem is received through the slider and attaches to the manifold. For filling, the top opening of a bottle is placed against a spanner nut and the manifold lowered, thereby compressing the slider into the manifold to insert the stem into the container. A liquid is then injected into the container, while displaced air is exhausted into the co-axial annular space between the stem and the slider. The stem also preferably contains four outlet ports.

11 Claims, 9 Drawing Sheets

METHOD AND APPARATUS FOR A FILLER VALVE

TECHNICAL FIELD

The invention relates to a method and apparatus for filling valves for use in container filling machines and more particularly to a filler valves specially configured for attachment onto conventional, high speed, container fluid filling systems.

BACKGROUND OF THE INVENTION

Container filling machines are widely utilized in food product container packaging lines to quickly fill large numbers of containers. The efficient and reliable operation of the filling valves of these filling machines is critical to the process. Historically, the quick and economical filling of containers has been an object of a large number of devices. Container filling machines have evolved over the years from simple mechanisms to complex devices, yet with many features evolving and improving over time.

An example of an early device with advanced features is the U.S. Pat. No. 2,671,591 to Franz. Franz '591 discloses a mechanism for filling containers with a liquid, such as milk. The Franz '591 apparatus includes a central exhaust passage with an annular liquid fill port. A problem with Franz '591 is that it relies on gravity flow to fill the bottle, after the air pressure with the bottle equalized with the air reservoir above the filling liquid. Franz '591 fails to provide a mechanism that can fill at higher flow rates.

The filling of a container with carbonated liquids requires a pre-pressurization of the container to prevent foaming. This pre-pressurization step is not required in filling containers with non-carbonated liquids. Carbonated liquid filling mechanisms, though showing aspects potentially applicable to noncarbonated liquid filing mechanisms, typically all fail to efficiently operate in non-carbonated systems.

Some carbonated liquid fillers are notable in that they include features that would be desirable in no-carbonated liquid fillers. An early example of a carbonated system filling device is the U.S. Pat. No. 3,460,589 to Justis. Justis '589 shows a filling head apparatus for filling containers with carbonated beverages. Justis '589 teaches the flow of a liquid through a valve's central filling tube, while also injecting an inert counter pressure gas through the valve's concentric outer tube. The filling of a bottle with liquid from the central filling tube appears to improve the filling mechanism. However, Justis '589 also rotates a valve head rotates above the bottle to coordinate the counter-filling of the gas and filling the bottle with the liquid. This rotating valve of the Justis '589 device is quite complex and includes bottle pressurization features that are not required in non-carbonated filling systems.

A later example of carbonated system filling devices is shown in U.S. Pat. No. 4,442,873 to Yun. Yun '873 also shows a counter-pressure, carbonated liquid filling mechanism. Yun '873 includes a less desirable central vent tube that is utilized with a concentric liquid filling valve. Although Yun '873 is another counter-pressure valve, it does show a simplified configuration that avoids the complex cams and valves of many previous patents. However, the Yun '873 valve system includes a complex array of bias springs that together operate to control the action of the valve. Yun '873 fails to provide an easily adjustable valve with the ability to easily fine tune and adjust the actions of the valve.

U.S. Pat. No. 5,139,058 to Yun shows an improvement in a counter pressure filling mechanism. Yun '058 is similar to Yun '873, but adapted for cans rather than bottles. Yun '058 also includes a central vent tube that is utilized with a concentric liquid filling valve, but again, as with Yun '873, fails to provide an easily adjustable valve with the ability to easily fine tune the actions of the valve.

Additionally, comparing Yun '058 to Yun '873, it can be seen that it is presumed that significantly different mechanism are required to fill bottles, as compared to cans. A new container may be desired for a variety of reasons; to fill a market niche, for example, or simply to reduce expense. Typically, any new container type requires extensive retooling and filling valve modification or replacement. A universal valve for a variety of container types would be very desirable, and enable a filling line to quickly respond to consumer demand, market niches and improved container designs.

Another non-carbonated liquid filling valve is typified by the "BM8316" valve, produced by U.S. Bottlers Machinery Company, of Charlotte N.C., U.S.A. The BM8316 valve includes a central filler stem that is mounted to a filling machine. The filler stem is received within an exhaust manifold, which slides upward along the filler stem, toward the filling machine to expose the head of the filler stem when the valve is inserted into a bottle. The bottle impacts a flange at the base exhaust manifold and forces the exhaust manifold up to reveal the filler stem into the bottle. As the filler stem supplies a liquid into the bottle, the air within the bottle is exhausted through the annular space between the filler stem and the exhaust manifold. A biasing spring is included on the top of the exhaust manifold maintains the filler stem in a retracted position within the exhaust manifold, when the flange is not supported by the bottle.

The BM8316 valve also has several problems. The biasing spring of the BM8316 can not be easily adjusted. It provides a single, predetermined tension. Often, fine tuning of the spring's tension is required when the moving parts of the valve become sticky, bent or in some other way resist the sliding of the filler stem. A user can not compensate for an individual BM8316 valve's unique operation, without shutting down the filling line, removing the entire valve and either unsticking the valve or replacing the bias spring with a spring that may or may not be appropriate. A filling valve is needed that utilizes the superior center filling stem and overcomes the problems encountered in the function of conventional filling valves, as discussed above.

The filler stem of the BM8316 is a desirable feature for non-carbonated liquid filling. A valve configuration with the liquid filling from the center and the air exhausted from above and outside the filler stem is reliable and efficient. This center filling feature operates much better than the configuration found in more traditional, carbonated liquid type valves. Many traditional valves fill from a filler sleeve, positioned outside of a central stem, while exhausting air from the central stem. Such a central exhausting valve, for use with non-carbonated liquids, is typified by a "T-316" nozzle assembly, manufactured by Laub/Hunt Packaging Systems of Norwalk Calif., U.S.A.

In normal use, the undesirable center exhausting stems of the Laub T-316 valve have a problematic tendency to hang-up while retracting into the filler sleeve. This intermittent failure occurs because the filling liquid requires deflectors in the head of the exhaust stem to keep the filling liquid from short circuiting into the air exhaust ports, which are also on the head of the exhaust stem. The result of this hang-up, is a significant loss of product through spillage. Spillage also occurs in the Laub T-316 valve if the liquid fails to automatically shut off when the valve is removed from the container. By design, the center exhaust can not recycle liquid up the center stem. Instead any residual liquid squirts out from the valve as it clears the container and rotates to the next container in line. These basic design failings of the Laub T-316 valve result in significant losses of product. A filling valve is needed with the ability to minimize the loss of product when the valve is not filling a container.

SUMMARY OF INVENTION

The invention provides a filler valve for filling a container with a liquid. The filler valve includes a manifold having a top end, a base end and a middle portion. A manifold cavity formed within the manifold. A liquid inlet port is located proximate the top end of the manifold and is open to the manifold cavity. An exhaust port, which is also open to the manifold cavity, is located proximate the middle portion of the manifold. A stem receiver is also located within the manifold. A slider, having a manifold insert end and an exhaust inlet end, is received into the manifold cavity. A dampener is positioned at the base end of the manifold and abuts to the slider. The dampener is for resisting a retraction of the slider into the manifold cavity. A filler stem having a receiver end and a filling head end is received through the slider and mounted to the stem receiver of the manifold.

The preferred method of the invention includes the steps of positioning a top opening of the container against a spanner, the spanner located at a terminal end of the slider. The slider substantially encloses the filler stem and the slider is held in an extended position by the dampener. Then the dampener is compressed with the top opening of the container and the slider retracted into the manifold. A head portion of the stem is inserted into the container and a liquid injected from the manifold, through the stem, into the container. This action displaces air from the container, into a co-axial annular space between the filler stem and the slider. This displaced air is then exhausted into the manifold.

In another preferred embodiment of the invention, the slider and the filler stem can include tapered lengths to allow the filler valve to easily be employed for containers having smaller necks.

According to one advantage of the invention, the filler valve provides a mechanism that can fill at high flow rates.

According to another advantage of the invention, the filler valve efficiently operates in non-carbonated liquid filling systems and can readily retrofit to many existing filling systems.

According to yet another advantage of the invention, the filler valve is universally adaptable a variety of container types of different shape and material.

According to still another advantage of the invention, the filler valve utilizes a superior center filling stem.

According to another advantage of the invention, the filler valve has the ability to minimize the loss of product when the valve is not filling a container.

The invention will be better understood by reference to the following detailed description taken in conjunction with the accompanying drawings.

DETAILED DESCRIPTION OF SPECIFIC EMBODIMENTS

The present invention comprises a filler valve that is specially configured for attachment onto a conventional, high speed, fluid container filling system. As compared to conventional filling valves assemblies, the filler valve of the present invention includes novel features that result in a greater reliability in operation, increased operational speeds, and easier adjustments in operational parameters.

Figure 1:
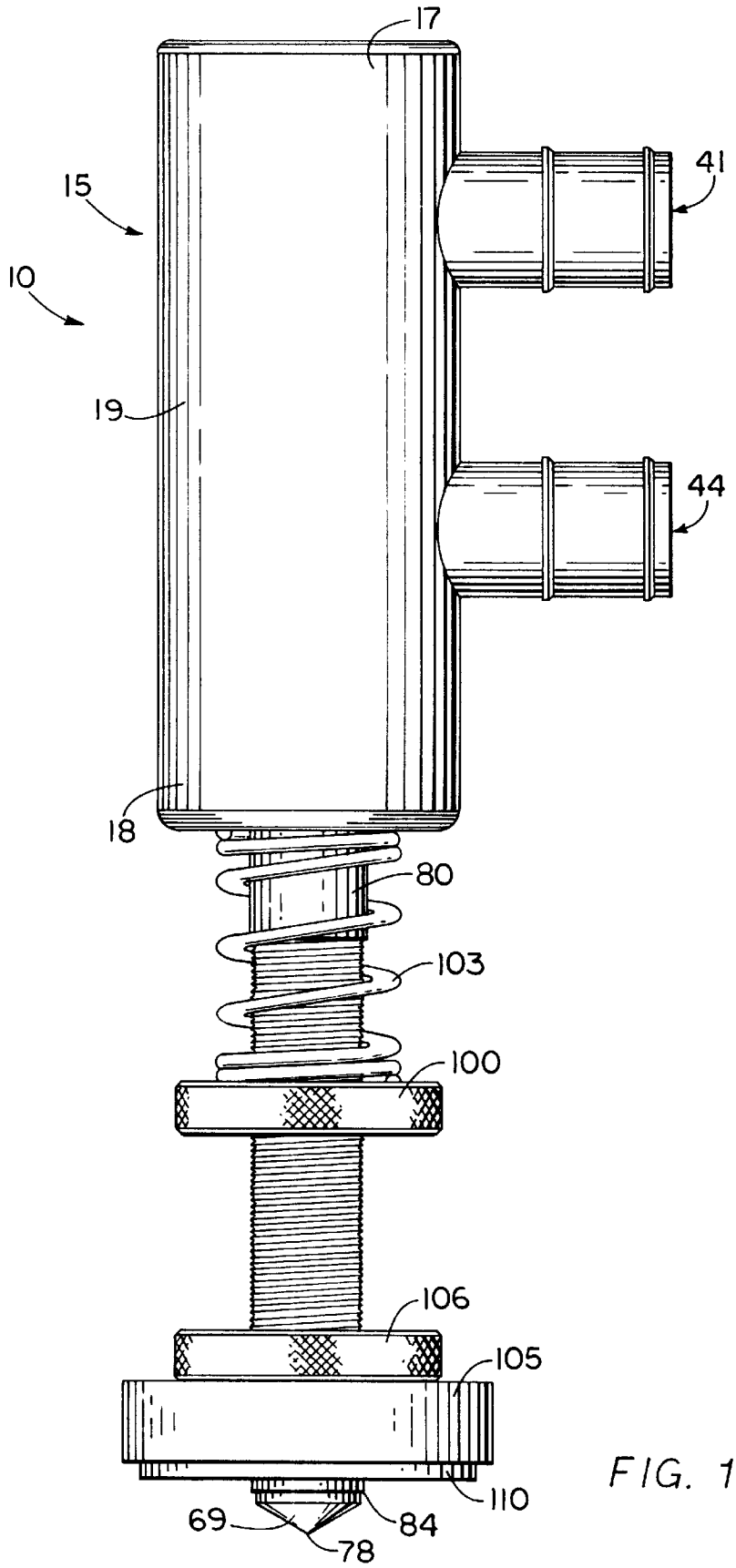
FIG. 1 is a side view of a filling valve, according to an embodiment of this invention.
Figure 2:
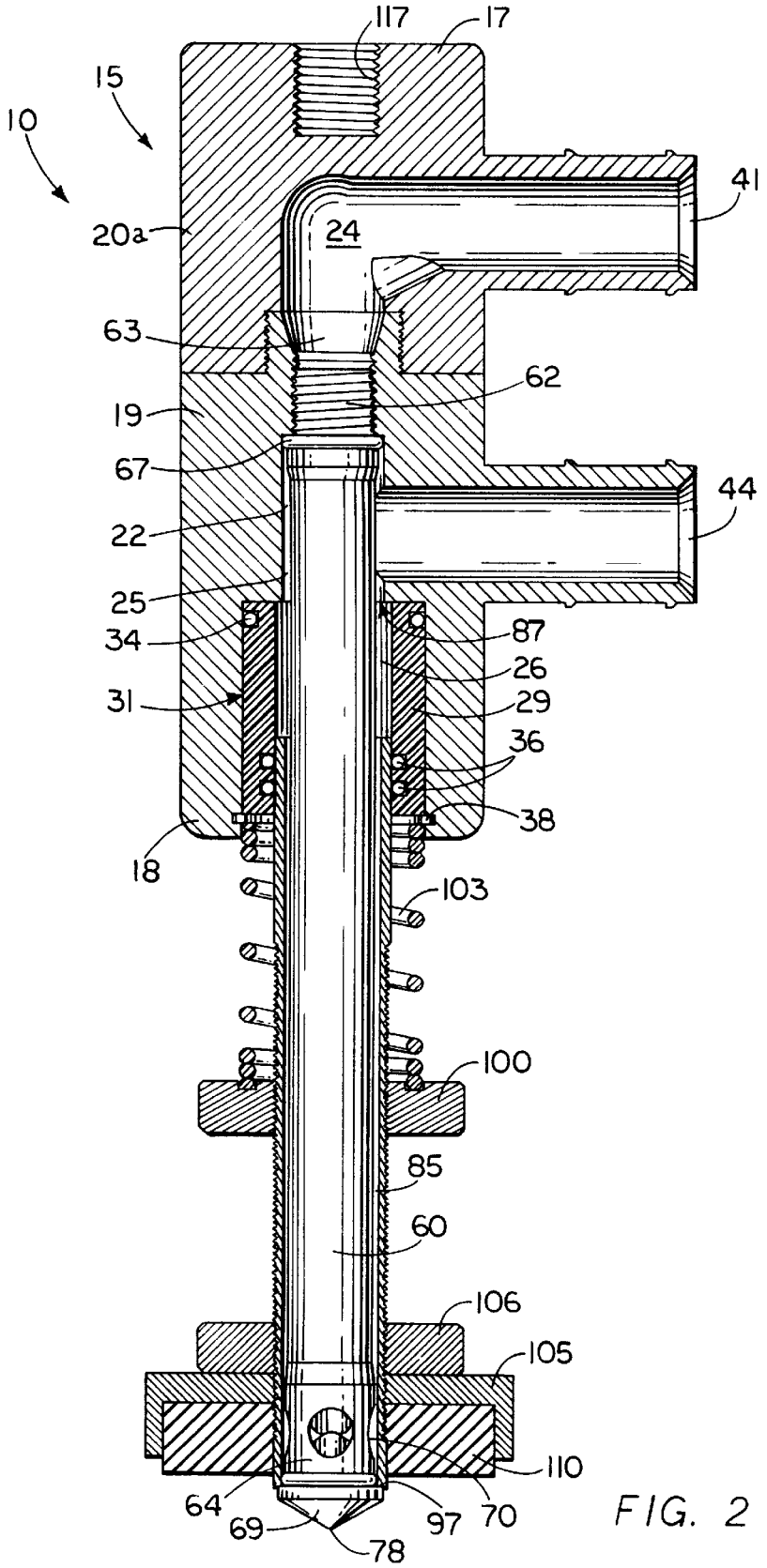
FIG. 2 is a sectioned side view of the filling valve.
Figure 3:
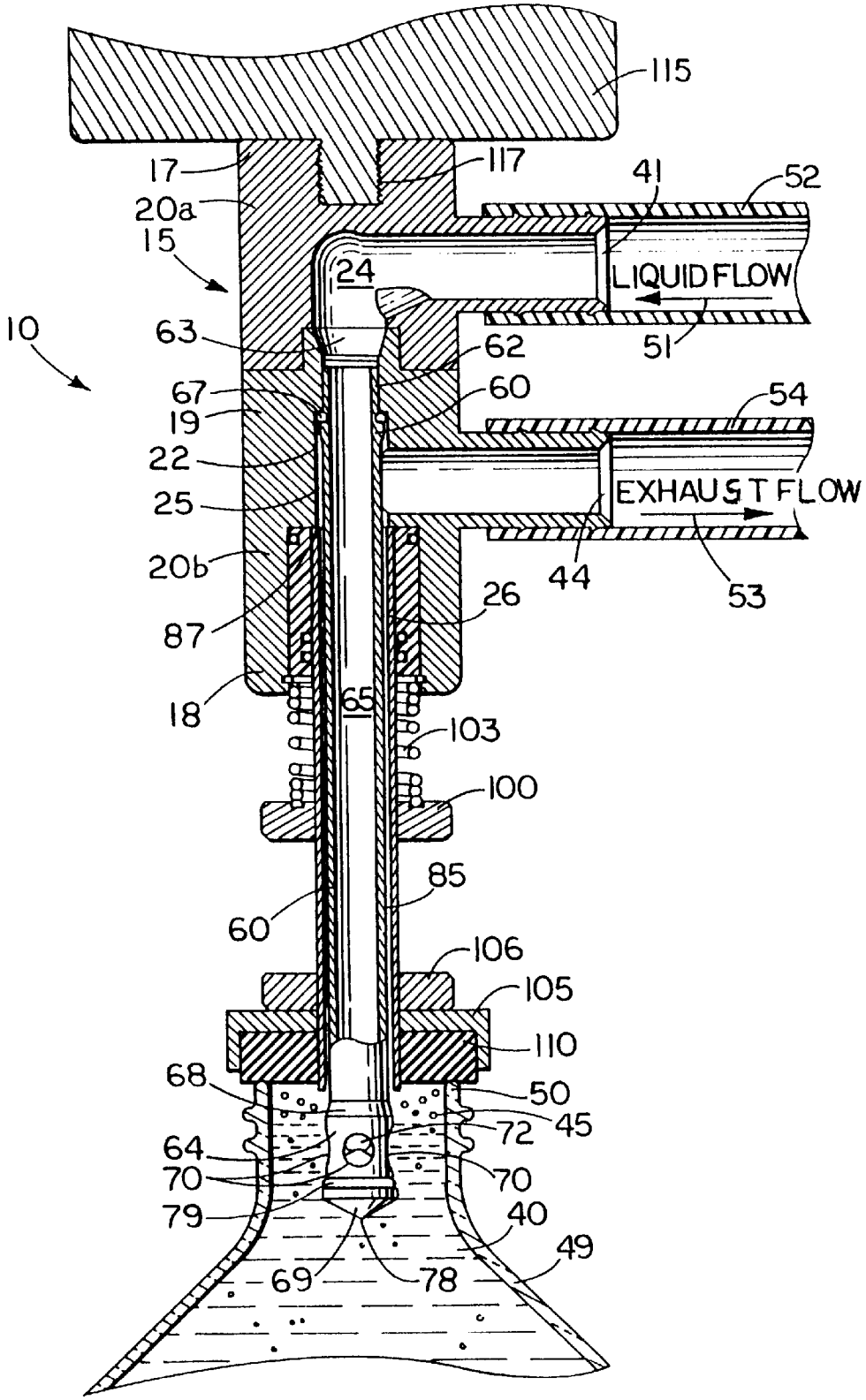
FIG. 3 is a partially sectioned side view of the filling valve.

FIGS. 1 through 3 show a filler valve 10, according to a preferred embodiment of the present invention. The filler valve includes a manifold 15 having a top end 17, a base end 18 and a middle portion 19, located between the top end and the base end. The manifold is preferably formed from a metal stock that is machine tooled to the desired dimensions. The manifold, as well as all metal components of the filling valve, are most preferably manufactured from a stainless steel. Most preferably, ANSI 316 (UNS S31600) stainless steel alloy is employed throughout. 316 stainless is most preferred because it is highly resistive to corrosion and is generally recognized as acceptable for food grade uses, especially with acidic fruit juices and harsh chemicals. Other stainless steel alloys are considered by the inventor, for selection as dictated by their properties such as machinability and resistance to corrosion.

Figure 4:
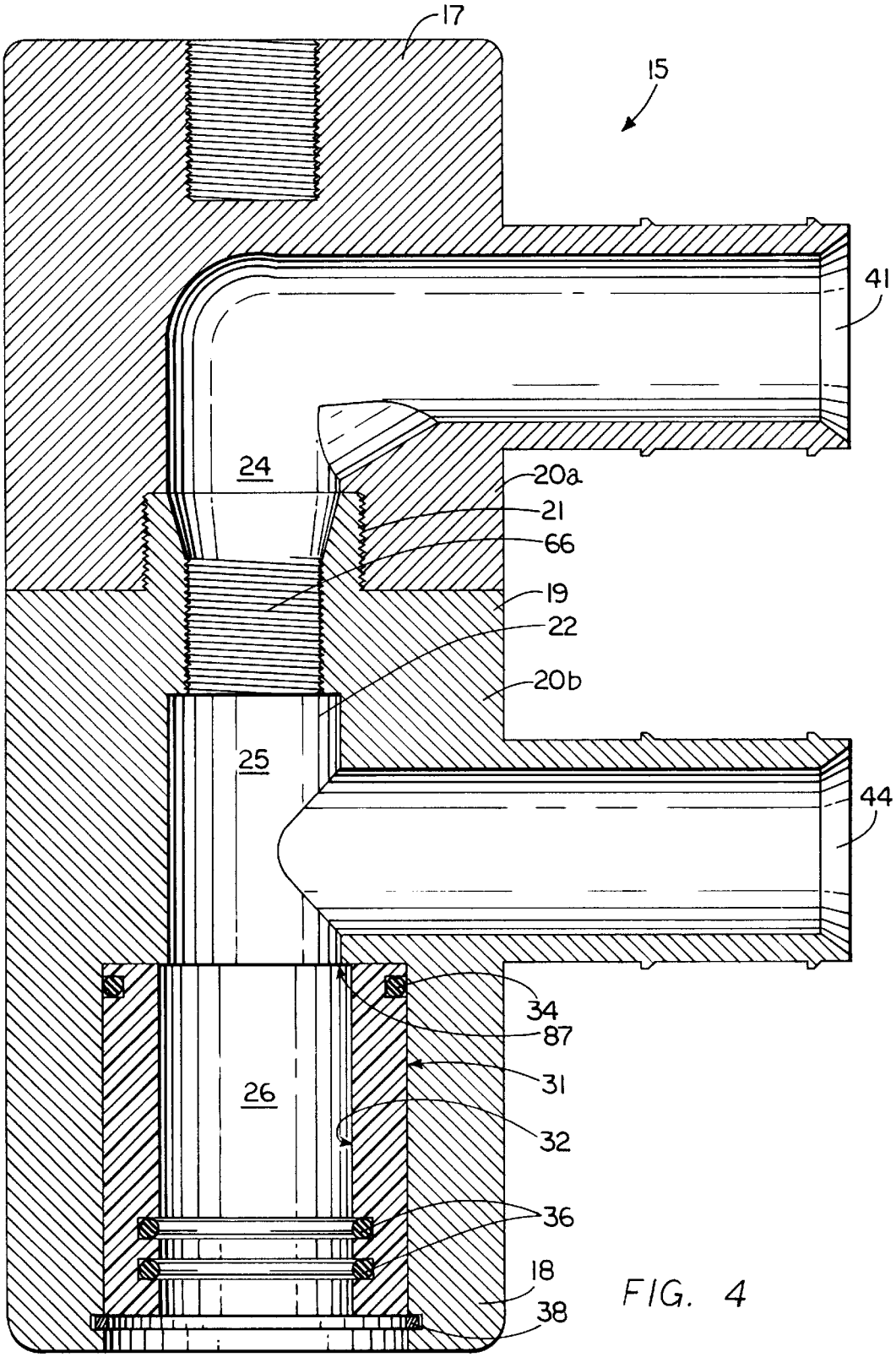
FIG. 4 is a sectioned side view of a manifold of the filling valve.

As shown in FIGS. 2 through 4, the manifold 15 also includes a manifold cavity 22, formed within. The manifold cavity comprises an upper cavity 24 proximate the top end 17 of the manifold 15, a middle cavity 25 proximate the middle 19 of the manifold, and a lower cavity 26, proximate to the base end 18 of the manifold. As preferred, and detailed in FIG. 4, the manifold is comprised of two pieces; a first piece 20*a* that includes the upper cavity, mounted upon a second piece 20*b* that includes the middle cavity and the lower cavity. As preferred, the first and the second piece are joined together by a threaded joining connection 21 and then welded across the interface between the first piece and the second piece, to provide a permanent and sealed connection. Alternatively, the first piece of the manifold can be omitted to facilitate retrofit attachment of the filler valve to an existing filling line.

As shown in FIGS. 2 through 4, the manifold cavity 25 includes a minimum of sharp edged and right angled transitions. A ball end milling tool (not shown) is preferably utilized to form the transition between the upper cavity 24 and the liquid inlet port 41. Additionally, concentrically shaped reductions are formed whenever possible, within the manifold cavity.

As also shown in FIGS. 2 through 4, and detailed in FIG. 4, the lower cavity 26 of the manifold 15 receives a slider bushing 29. The slider bushing is generally cylindrical, and includes an outer surface 31 and an inner surface 32. The slider bushing preferably formed from a plastic material that provides a low friction coupling between the slider and the manifold. Most preferably, a high grade silicone or polyurethane material is utilized to form the slider bushing. Ertalite® brand, millable thermoplastic compound, as manufactured by Erta, Incorporated of Eaton Pa., USA, performs well. As alternatives, the inventor has found Teflon® and silicon products, as well as some nylon materials can perform adequately.

Preferably, the slider bushing 29 also includes a plurality of O-rings to provide a gas tight seal between the slider and surfaces that contact the inner surface 32 and outer surface 31 of the slider. Most preferably, an outer O-ring 34 is located on the outer surface of the slider and an inner O-ring 36 is located on the inner surface of the slider. Most preferably, two inner O-rings 36 are included, as shown in FIGS. 2 through 4. The O-rings are conventional, heat resistant, silicon seals or Viton® brand seals, as manufactured by DuPont of Wilmington Del., U.S.A., and preferably manufactured for high heat, food grade use.

As also detailed in FIG. 4, the slider bushing 29 is confined within the lower cavity 26 of the manifold 15 by a snap ring 38. The snap ring is preferably of a conventional form and manufactured of a stainless metal. The snap ring is an open ended ring that is received within a lock ring grove 39 at the base end 18 of the manifold, within the lower cavity. The snap ring prevents the slider bushing from moving upward, toward the top end 17 of the manifold, or downward toward the base end of the manifold.

The filler valve 10 operates to direct liquid 40 and gas 45 flow through the manifold 15 and into a container 49. The container can be of a wide range of shapes and sizes, and formed from a variety of materials. Besides plastic and glass bottles, cans may also be filled with the present invention, such as conventional, two-part aluminum or steel cans. The typical container as shown in FIG. 3, includes a neck 50, which is an opening for receiving a liquid. The liquid for filling the container is received into the manifold through a liquid inlet port 41. The liquid inlet port is located proximate the top end 17 of the manifold and is open to the upper cavity 24 of the manifold. The liquid for filling can be any reasonably fluid material that is desired for delivery into the container. At the liquid inlet port, an inlet directional arrow 51 is shown in FIG. 3, and therein referred to as "LIQUID FLOW". A liquid delivery hose 52 is preferably attached to the liquid inlet port to supply the liquid from a reservoir or pump (not shown). The liquid delivery hose is preferably formed of a high pressure, fiber reinforced rubber or silicon food grade hose.

The manifold 15 also includes an exhaust port 44. The exhaust port serves as an outlet for an air 45 exhaust stream. The air initially fills the container, but is the container is filled, the air is drawn through the lower cavity 26 and into middle cavity 25 of the manifold cavity 22. The exhaust port is located proximate the middle portion 19 of the manifold. The exhaust port is open to the middle cavity of the manifold. The air exhausted through the exhaust port is displaced from the container 49, when the container is filled by the liquid 40. At the exhaust port, a directional arrow 53 is shown in FIG. 3, and therein referred to as "EXHAUST FLOW". Preferably the exhaust port is connected to a suction source, to facilitate rapid removal of the air. An exhaust hose 54 is preferably attached to the exhaust port 44 to supply the liquid from a reservoir or pump (not shown). The exhaust hose is preferably a vacuum rated hose, formed of a high pressure, fiber reinforced silicon food grade or rubber material.

Alternatively, the air 45 displaced from the container may be any gas. When the liquid 40 for filling is potentially explosive, it is undesirable to have oxygen present. An inert gas filling environment, employing a gas such as nitrogen or carbon dioxide, could be utilized to instead of the air. This would greatly reduce the possibility of the liquid contacting oxygen containing gasses.

Again referring to FIG. 3, it can be observed that from the liquid inlet port 41, the liquid 40 for filling flows through the upper cavity 24 of the manifold 15 and into a filler stem 60. The filler stem has a receiver end 62 and a filler head 64. The filler stem is preferably cylindrical and includes a stem interior 65 for the liquid. The receiver end is preferably threaded and attaches to a stem receiver 66 positioned within the manifold. The stem receiver is located proximate a junction between the upper cavity and the middle cavity 25. The stem receiver is preferably a threaded mounting for the receiver end of the filler stem and preferably includes a concentric reduction in diameter 63 from the upper cavity. Additionally, a stem O-ring 67 is included proximate the junction of the receiver end and the stem receiver. The stem O-ring provides a seal for preventing the liquid from leaking through the threaded mounting of the stem receiver.

Figure 7:
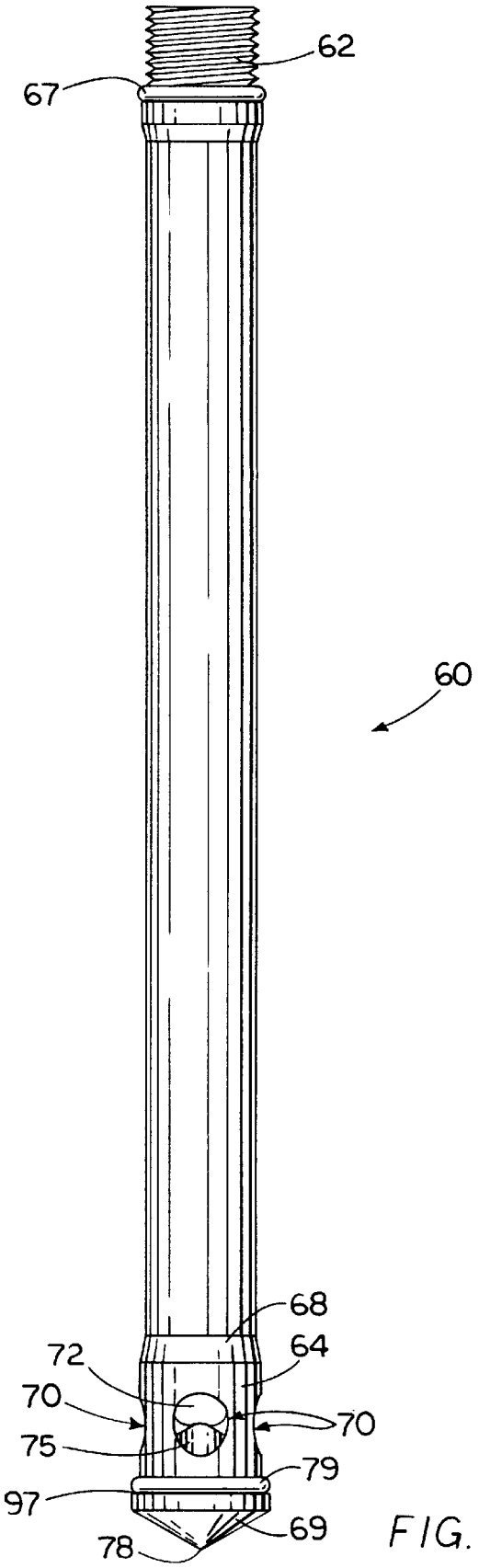
FIG. 7 is a side view of a filler stem of the filling valve.
Figure 8:
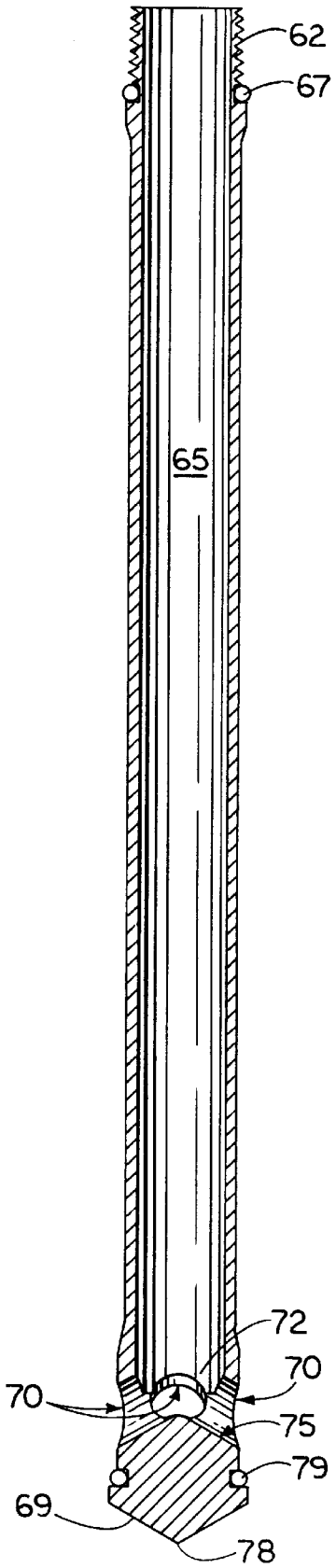
FIG. 8 is a sectioned side view of a filler stem of the filling valve.

The filler head 64 of the filler stem 60 can attach to the filler stem by a threaded attachment. Alternatively, the filler head can be welded to the filler stem. Preferably the filler head and the filler stem are formed by conventional machinist methods from a single piece of material; most preferably from a similar stainless metal alloy as employed for the manifold 15. The filler head is most preferably configured as shown in FIGS. 7 and 8. The filler head includes a stem reduction 68 and a tip 69. Also, the filler head preferably includes a plurality of fill ports 70 and a head interior 72 within the filler head. The head interior is open to the stem interior 65 of the filler stem. The fill ports provide a directional outlet for the liquid 40 to flow from within the manifold body and the filler stem 60 into the container 49. The interior of the filler head also preferably includes a deflection surface 75. The deflection surface helps to route flow of the liquid out of the fill ports, to thereby minimize turbulent flow and additionally to minimize liquid hammer onto the tip of the filler head.

The inventor of the present invention has discovered that the configuration of the fill ports 70, as specifically detailed in FIGS. 7 and 8, with four equally spaced ports positioned about the filler head 64, are preferred. Four radially directed fill ports significantly reduce the turbulence and foaming typically encountered when two fill ports are employed, as found in many conventional filling valves.

The tip 69 of the filler head 64 extends slightly to a tip point 78, as shown in FIGS. 1 through 3, 7 and 8. The tip point has an extended configuration that helps center the filler head and attached filler stem 60 into the container 49. The filler head also preferably includes a tip O-ring 79, positioned between the tip and the fill ports 70.

The filler stem 64 is sheathed by a slider 80 as specifically shown in FIGS. 2 and 3. The slider is also preferably formed from a stainless steel. As detailed in FIGS. 5 and 6, the slider is a cylindrical sleeve that includes a manifold insert end 82 and a gas inlet end 84. Again referring to FIGS. 2 and 3, the manifold insert end of the slider is received up and into the lower cavity 26 of the manifold 15. Between the slider and the filler stem, an exhaust annulus 85 is formed. The exhaust annulus provides a path for exhausted air 45, which enters the gas inlet end of the slider, to the middle cavity 25 of the manifold.

The slider 80 is prevented from traveling into the middle cavity 25 of the manifold 15 by a cavity stop 87, located between the lower cavity 26 and the middle cavity. The cavity stop is a ledge structure within the manifold cavity 22 that results from the middle cavity 25 being formed with a diameter slightly less than the outside diameter of the slider. The cavity stop prevents the slider from obstructing the exhaust port 44, but more importantly, the cavity stop prevents the filler stem 60 from extending further into the container 50 than desired.

As discussed herein above, the lower cavity 26 of the manifold 15 receives the slider bushing 29. The slider bushing has an inner diameter slightly larger than the slider. The slider is received into the slider bushing and can slidingly travel back and forth within it. The outer O-ring 34, located on the outer surface of the slider, prevents leakage between the slider bushing and the manifold. The inner O-rings 36, located on the inner surface of the slider, prevents leakage between the slider bushing and the slider. As discussed above, a single outer O-ring and a pair of inner O-rings are preferred, however, as an alternative, either set of O-rings could be substituted by a variety of known sealing O-ring configurations.

The slider 80 travels between the cavity stop 87 of the manifold, as shown in FIG. 3 and a tip stop 97 that is formed on the tip 69 of the filler head 64, as shown in FIG. 2. The tip stop is located on the tip between the filler ports 70 and the tip point 78. The tip flares out to the tip stop, the tip stop having a slightly larger diameter than the exhaust inlet end 84 of the slider. The slider is thereby prevented from sliding past the tip stop, confining the manifold insert end of the slider within the lower cavity 26 of the manifold.

As shown in FIGS. 1 through 3, 5 and 6, the slider 80 preferably includes a threaded portion 99 to receive a tension nut 100. The tension nut is positioned to adjust the compression of a dampener 103. The dampener, as shown in FIGS. 1 through 3, is positioned between the tension nut and the base end 18 of the manifold 15. The dampener preferably abuts to the base end of the manifold, and resistively dampens the retraction of the slider into the lower cavity 26. The dampener is preferably a spring that is most preferably manufactured from a stainless steel. A user of the present invention can easily turn the tension nut, even while the filler valve 10 is operating. Turning the tension nut either compresses or decompresses the dampener to respectively increase or decrease the sliding resistance of the slider. This feature is of a great advantage as compared to conventional filler valves. Because, conventional filler valves are attached or mounted to a structural support on filling lines that typically include multiple filler valves for simultaneously filling multiple containers, these conventional filler valves offer little control of the filler head's extension from the slider. This requires the conventional filler valve to be removed from the structural support on the filling line, and adjusted by either replacing the spring, or by rebuilding a moving component of the valve.

Figure 5:
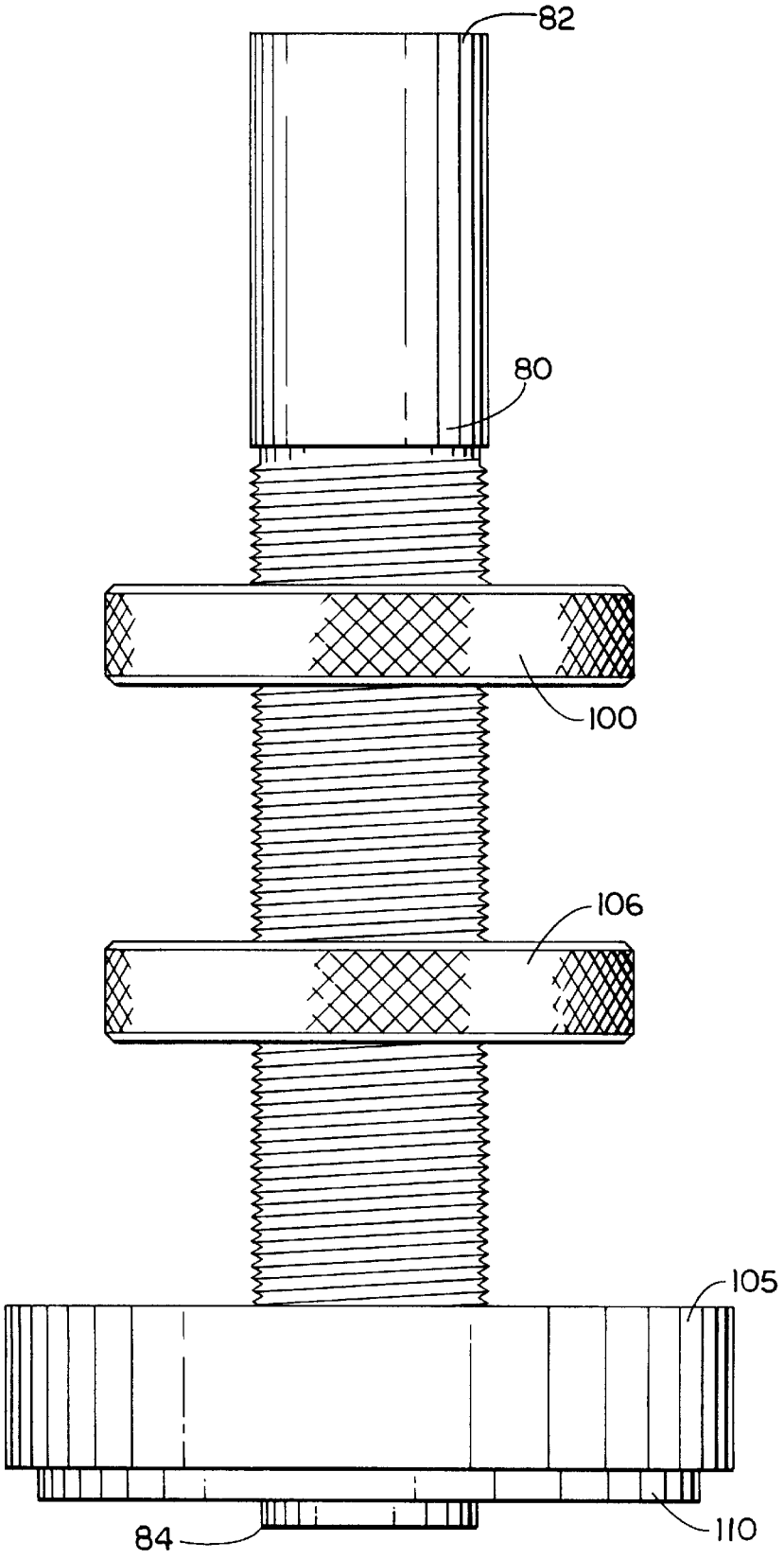
FIG. 5 is a side view of a slider of the filling valve.
Figure 6:
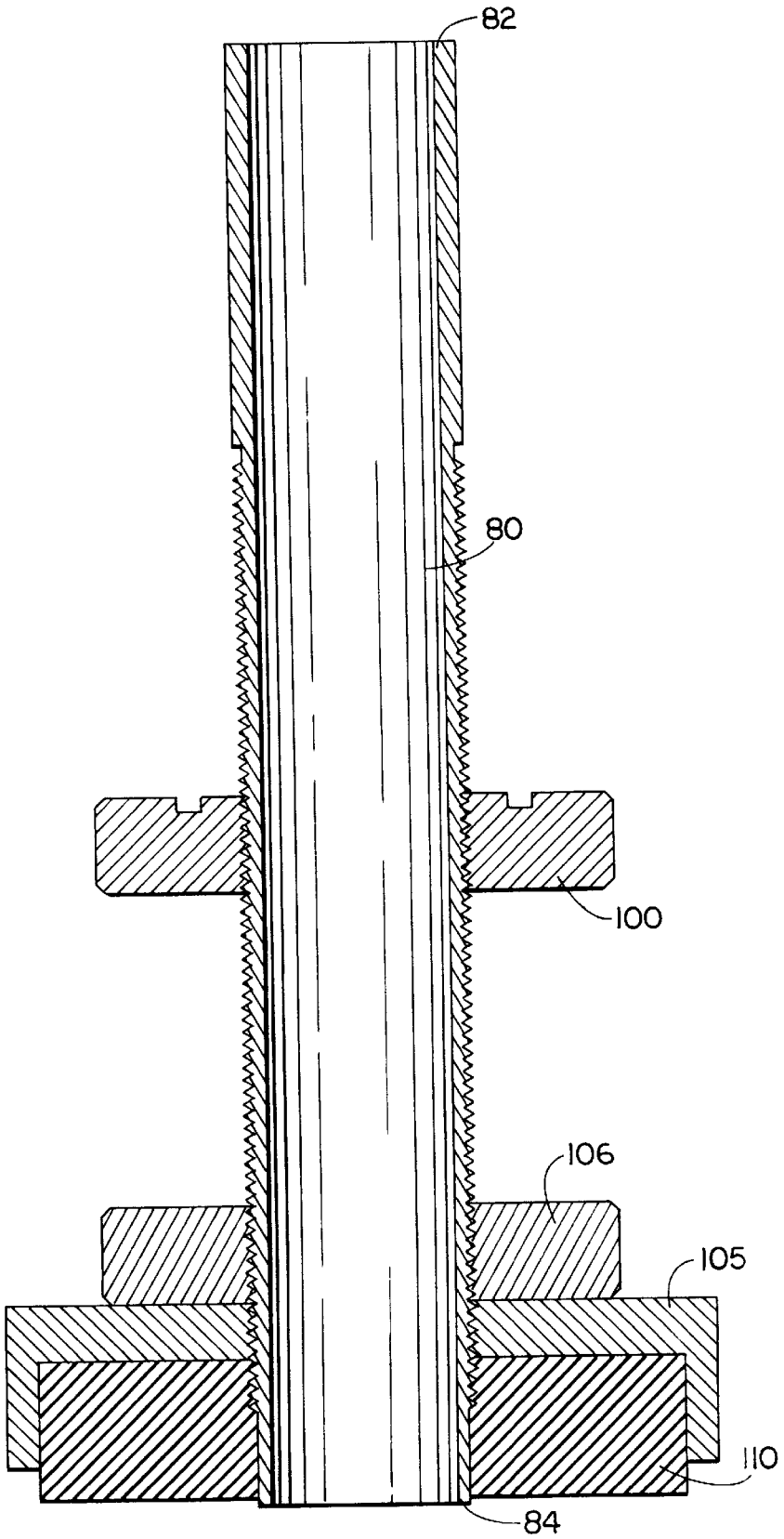
FIG. 6 is a sectioned side view of a slider of the filling valve.

In the filler valve 10 of the present invention, as shown in FIGS. 1 through 3 and detailed in FIGS. 5 and 6, a spanner nut 105 is also included proximate the exhaust inlet end 84 of the slider 80. The spanner nut abuts to the container 49 for preventing the liquid 40 from spilling out of the container during the filling process. Also the spanner nut provides a contact against the container for forcing the slider upward and into the manifold 15. As the slider is forced upward into the manifold cavity 22, the filler stem 60 extends into the container.

The spanner nut 105 preferably includes a seal 110. The seal is preferably a rubber material that seats within the spanner nut. As shown in FIG. 3, the seal cushions the abutment of the spanner nut to the neck 50 of the container 49 and provides a leak resistant seal between the spanner nut and the container.

As shown in FIG. 3, the manifold 15 is mountable to the structural member 115 of the filling line. Preferably, a manifold attachment 117 is provided on the top end 17 of the manifold, as shown in FIG. 3. The manifold attachment is most preferably threaded, thereby allowing the entire filling valve to mount onto the structural member of a conventional filling device frame.

For filling, the top opening of a bottle, or the neck 50 the container 49 is placed against the spanner nut 105. The manifold 15 is then lowered, typically by lowering the structural member 115 of the filling line, thereby compressing the slider 80 into the lower cavity 26 of the manifold, which thereby extends the filler stem 60 into the container. As the filler stem extends into the container, the stem reduction 68 extends past the exhaust inlet end 84 of the slider and creates an open path for air 45, which is displaced by the filling of the container, to flow up and into the exhaust annulus 85, between the filler stem and the slider.

From the liquid delivery hose 52, the liquid 40 is received into the upper cavity 24 of the manifold 15, through the liquid inlet port 41. The liquid is transferred through the upper cavity and into the filler stem 60, preferably by following smooth transitions within the manifold cavity 22, designed to minimize turbulent flow conditions. The liquid is then forced down the filler stem and injected into the container 49, from the filler ports 70 that are located in the filler head 64.

The air that is displaced by the entering liquid is exhausted to the exhaust inlet end of the slider an into the co-axial annular space between the stem and the threaded slider. The air flows into the middle cavity of the manifold and out the exhaust port, into the exhaust hose 54.

A novel feature of the present invention is that the exhaust annulus 85 can also serve to recirculate the liquid 40. To prevent the liquid from overflowing out of the container 49 while the filler stem 60 is extended, as shown in FIG. 3, the liquid is pulled up and into the exhaust inlet end 84 of the slider. This is accomplished because the tip O-ring 79 effectively seals the exhaust end of the slider and prevents liquid delivered through the fill ports 70 from exiting into the container. The liquid is recirculated up the exhaust annulus 85, into the middle cavity 25 of the manifold 15 and out the exhaust port 44 and into the exhaust hose 54, where it is delivered to a receiver vessel (not shown) so that the liquid can be collected and recirculated to the supply pump (not shown) to again be fed to the liquid delivery hose 52 of the filler valve 10. This recirculating feature saves considerably on product losses normally encountered while the filler valve is moving between containers.

The filler valve 10 of the present invention is easily adjusted. The desired fill level of the liquid 40 into the container 49 is selected by setting a proper, desired distance between the spanner nut 105 and the fill ports 70. The height of the spanner nut on the slider 80 can be adjusted by rotating a locking nut 106 to abut the spanner nut. The locking nut threads onto the slider, and is located above the spanner nut, proximate the exhaust inlet end 84 of the slider. The container abuts to the seal 110, which is held in place by and positioned beneath the spanner. When the container is filled to a desired level, over-fill is avoided because the liquid begins to recirculate up and into the exhaust end of the slider. The distance between the exhaust end of the slider and the seal can be adjusted to maintain the liquid fill to any level, thereby providing exact product control and minimizing foam-over out of the container.

Figure 9:
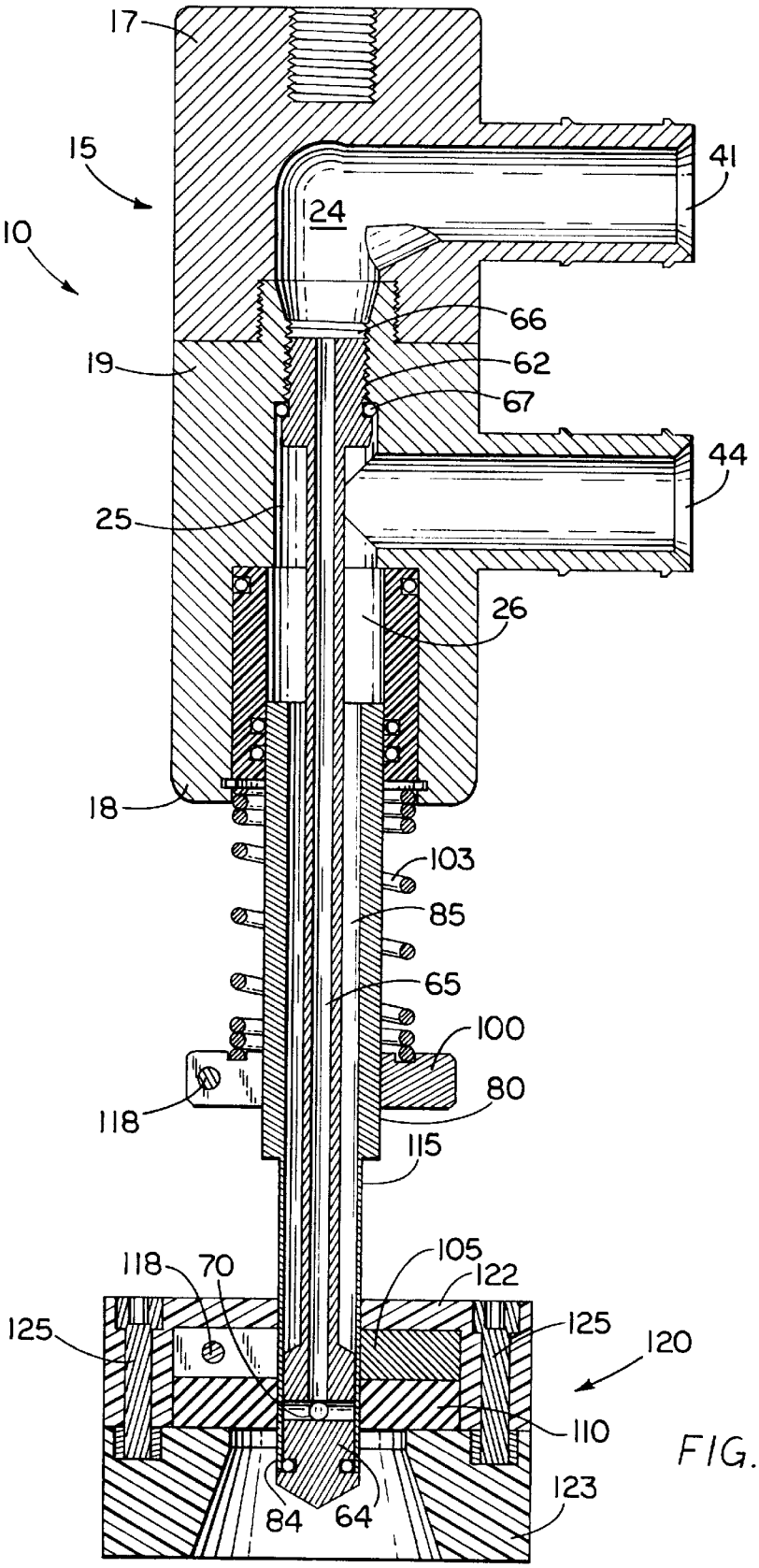
FIG. 9 is a side view of a sectioned side view of the filling valve, according to another embodiment of this invention.

Alternatively, as shown in FIG. 9, the filler valve 10 of the present invention can include a tapered or stepped slider 80. In this alternative embodiment, the slider can include a taper 115 to fit into the neck of containers 49 that would not be able to receive a slider with a wider diameter, or as configured as described in the preferred alternative of the present invention. To fit within the tapered slider, a filling stem having a tapered length 116 and a filler head 64 of a smaller diameter is also utilized. FIG. 9 also shows an alternative fill port configuration on the filler head. The filler head of FIG. 9 includes four fill ports 70, however with the smaller filler head, the formation of smooth transitional surfaces becomes more difficult. An intersecting pair of penetrations through the filler head that communicates with the interior stem 65 can be employed to maintain a four fill port configuration as preferred.

The alternative embodiment of FIG. 9, also shows a less desirable, but efficient, clamp-style tension nut 100 and spanner nut 105. The adjustment of these clamp-style nuts is achieved by loosening an adjustment screw 118, then sliding the nut along the slider 80 and finally re-tightening the appropriate adjustment screw to lock the nut in the desired position. The threaded alternative of the invention is preferred, however, threads are more costly to manufacture than the nonthreaded, clamp-style embodiments.

FIG. 9 also shows an improved, detachable centering bell 120 that is especially convenient for receiving the neck 50 of the container 49, when the neck 50 of the container 49 is narrow. The centering bell is preferably configured as shown in FIG. 9 and includes a cap piece 122 and a bell piece 123. The cap piece and the bell piece sandwich over the spanner nut and the seal, and are preferably held together by screws 125, to provide a circular channel for guiding the neck to a center position contact to the seal 110.

The remarkable advantage of the alternative embodiment of the present invention, as shown in FIG. 9, is that a filler valve 10 configured as preferred, in FIG. 2, can be quickly and economically modified to the configuration shown in FIG. 9. Specifically, the filler stem 60 can be unscrewed from the stem receiver 66. This allows the slider 80 to be pulled out of the lower cavity 26 of the manifold 15. Then, the alternative slider with the tapered configuration, and having the desired spanner nut 105 and seal 110, can be inserted into the lower cavity, and the alternative filler stem screwed into the stem receiver. This simple change-out can be performed while the manifold is attached to the support structure 115, and requires no special tools.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the following claims, as appropriately interpreted in accordance with the doctrine of equivalents.

What is claimed is:

1. A filler valve for filling a container with a liquid, said filler valve including:

a manifold having a top end, a base end and a middle portion;

a manifold cavity formed within said manifold, said manifold cavity having a upper cavity proximate the top end of said manifold and a middle cavity proximate the middle portion of said manifold, and a lower cavity proximate the base end of said manifold, the lower cavity adjacent and open to the middle cavity;

a liquid inlet port located proximate the top end of said manifold, said liquid inlet port open to the upper cavity;

an exhaust port located proximate the middle portion of said manifold, said gas exhaust port open to the middle cavity;

a stem receiver located within said manifold, between the upper cavity and the middle cavity;

a slider having a manifold insert end and an exhaust inlet end, the manifold insert end of said slider received into the lower cavity;

a dampener positioned at the base end of said manifold, the dampener abutted to said slider, and said dampener for resisting a retraction of said slider into the lower cavity; and a filler stem having a receiver end and a filling head end, the receiver end of said filler stem received through said slider and mounted to said stem receiver of said manifold.

2. The filler valve of claim 1, wherein the filler valve is for use with a conventional container filling system.

3. The filler valve of claim 1, wherein the filler valve further includes a manifold insert received into the lower cavity of said manifold.

4. The filler valve of claim 1, wherein said dampener is a tensioned spring.

5. The filler valve of claim 1, wherein said filling head includes multiple fill ports.

6. The filler valve of claim 1, wherein the top end of said manifold is mountable to a support structure.

7. The filler valve of claim 1, wherein said slider includes a taper proximate the manifold insert end of the slider, the taper receivable into a narrow necked container.

8. The filler valve of claim 7, wherein said filler stem includes a tapered length proximate the filling head end of the filling head, the tapered length receivable into a narrow necked container.

9. The filler valve of claim 1, wherein a co-axial annular space is formed between said filler stem and said slider, the co-axial annular space open to said exhaust port, the co-axial space for receiving a displaced air from the container, and transferring the displaced air into the exhaust port.

10. The filler valve of claim 1, wherein the filler stem is mounted to said stem receiver with a threaded mounting.

11. A method of filling a container with a liquid comprising, a) positioning a top opening of a container against a spanner, the spanner located at a terminal end of a slider, the slider including a manifold insert end received within a manifold, the slider substantially enclosing a filler stem, the filler stem attached to the manifold, and the slider held in an extended position by a dampener;

b) compressing the dampener with the top opening of the container;

c) positioning the slider to a retracted position into the manifold;

d) inserting a head portion of the stem into the container;

e) injecting a liquid from the manifold, through the stem, into the container;

f) displacing air from the container into a co-axial annular space between the filler stem and the slider; and g) exhausting the air into the manifold.

* * * * *